United States Patent [19]

Reiner et al.

[11] Patent Number: 4,549,599

[45] Date of Patent: Oct. 29, 1985

[54] PREVENTING MOLD AND CASTING CRACKING IN HIGH RATE DIRECTIONAL SOLIDIFICATION PROCESSES

[75] Inventors: Martin J. Reiner, South Windsor; Michael H. Fassler, Portland, both of Conn.

[73] Assignee: United Technologies Corporation, Hartford, Conn.

[21] Appl. No.: 131,291

[22] Filed: Mar. 17, 1980

Related U.S. Application Data

[63] Continuation of Ser. No. 952,904, Oct. 19, 1978, abandoned, which is a continuation-in-part of Ser. No. 731,409, Oct. 12, 1976, abandoned.

[51] Int. Cl.[4] ..... B22C 25/06

[52] U.S. Cl. ..... 164/122.1; 164/125; 164/361

[58] Field of Search ..... 164/23, 60, 122, 125, 164/361, 41; 106/38.27, 38.9; 427/133, 134

[56] References Cited

U.S. PATENT DOCUMENTS

| | | | |
|---|---|---|---|
| 2,594,998 | 4/1952 | Rocco | 164/122.2 |
| 3,367,393 | 2/1968 | Lenahan et al. | 164/361 X |
| 3,478,815 | 11/1969 | Worthington | 164/361 |
| 3,584,676 | 6/1971 | Busquet et al. | 164/122.2 |
| 3,700,023 | 10/1972 | Giamei et al. | 164/122.2 |
| 3,714,977 | 2/1973 | Terkelsen | 164/125 X |
| 3,724,531 | 4/1973 | Erickson et al. | 164/361 |
| 3,739,835 | 6/1973 | Copley et al. | 164/60 X |
| 3,763,926 | 10/1973 | Tschinkel et al. | 164/60 X |
| 3,942,581 | 3/1976 | Sawyer | 164/60 |
| 3,981,344 | 9/1978 | Hayes et al. | 164/361 X |
| 3,981,346 | 9/1976 | Hayes et al. | 164/60 |
| 4,186,222 | 1/1980 | Sellars et al. | 164/41 X |

FOREIGN PATENT DOCUMENTS

| | | | |
|---|---|---|---|
| 41630 | 4/1976 | Japan | 164/122.1 |

OTHER PUBLICATIONS

Molder 1 & C, Bureau of Naval Personnel, Navy Training Course, NAVPERS 10585-A, U.S. Government Printing Office, Wash., DC., 1962, pp. 154, 160 and 170.

*Primary Examiner*—Nicholas P. Godici
*Attorney, Agent, or Firm*—C. G. Nessler

[57] ABSTRACT

Insulating material is applied in selected mold surfaces and in critical thicknesses to prevent cracking of the mold and casting therein during the heating and cooling steps of high rate directional solidification processes.

2 Claims, 3 Drawing Figures

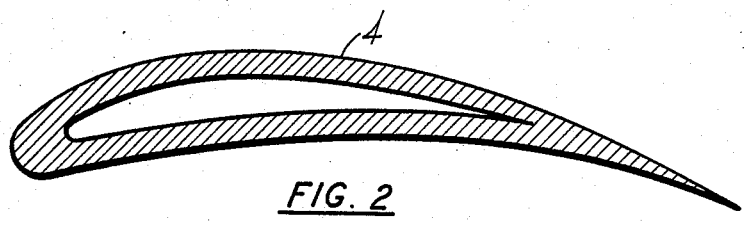
FIG. 2
FIG. 3
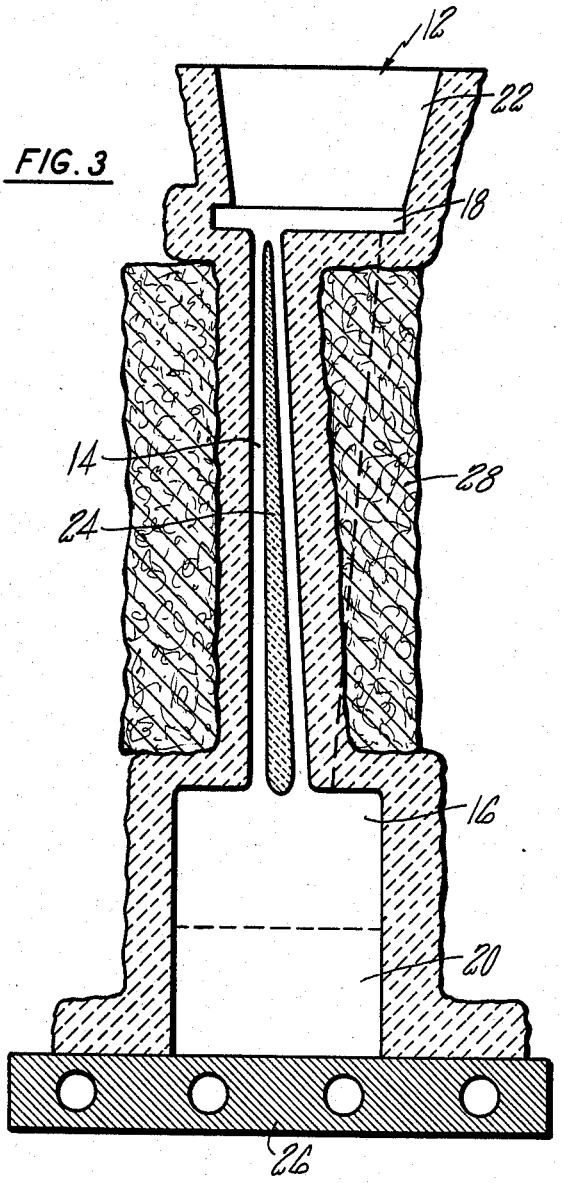
FIG. 1
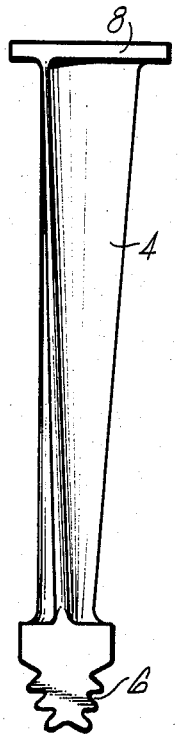

PREVENTING MOLD AND CASTING CRACKING IN HIGH RATE DIRECTIONAL SOLIDIFICATION PROCESSES

BACKGROUND OF THE INVENTION

This application is a continuation of application Ser. No. 952,904 filed Oct. 19, 1978 which was a continuation-in-part of application Ser. No. 731,409, filed Oct. 12, 1976, both now abandoned.

The present invention relates to high rate directional solidification processes and, more particularly, to a method for preventing cracking of the mold and metal solidified therein during the heating and cooling steps of such processes.

Directionally solidified turbine blade castings, such as columnar grained as described in VerSnyder, U.S. Pat. No. 3,260,505 single crystal as described in Piearcey, U.S. Pat. No. 3,494,709, have extended the efficiency and performance of gas turbine engines beyond that previously available with conventional castings. In more advanced high rate directional solidification processes, an investment shell mold of zircon, alumina, silica or mixtures thereof resting on a chill plate is heated to an elevated temperature in a heating zone, molten metal with a solidus in excess of 2000° F. is introduced into the heated mold and the mold is then withdrawn at rates from 2 to 20 inches per hour from the heating zone into a cooling zone where heat removal laterally from external mold surfaces in addition to vertically through the chill plate solidifies and then cools the metal at high rates. In one such process, lateral heat removal is by radiation from the mold surfaces, as shown in Giamei et al, U.S. Pat. No. 3,700,023 and in Terkelsen, U.S. Pat. No. 3,714,977. In another, lateral heat removal is by conduction from the mold surfaces as the mold is gradually immersed in a liquid coolant, such as molten tin, as described in Tschinkel et al, U.S. Pat. No. 3,763,926. In these sophisticated solidification processes, heat removal both laterally and vertically through the chill plate provides the very high thermal gradient required for achievement of high rate directional solidification. Of course, any disturbance or disruption of the thermal gradient can result in defective grain growth, such as the formation of freckles or equiaxed grains in the casting. One method of achieving uniform grain growth is to surround the mold defining the desired casting with another mold cavity into which additional molten metal is introduced and concurrently solidified, as described in Copley, U.S. Pat. No. 3,739,835. The extra molten metal has a stabilizing effect through its mass and creation of relatively constant total casting cross section at any point above the chill plate. However, this method has the disadvantage of substantially increasing the metal cost, casting time, and casting cleanup time.

In directional casting of turbine blades and like shapes such as vanes, the mold utilized has a complexly shaped and contoured casting cavity, most often with large gate sections at the upper and lower ends, and frequently smaller gating sections at various points. As compared to the end sections, the airfoil section of the mold is very long and thin, and has a large surface area to volume ratio. Cracking of ceramic molds prior to the introduction of molten metal occurs at times, particularly where there are section size changes in the mold or gating; this causes the molten metal to run out of the mold. Another problem encountered at times is that the metal part is observed to be cracked upon removal from the mold.

One explanation for the cracking of one section of a particular design mold or casting, compared to another, is based on analysis of heat transfer during heating and cooling: a presumption of constancy of mold manufacture and casting cycle can be made. The airfoil section and small gates have higher surface area to volume ratios than the larger end sections and primary gates. Therefore, they would respond more rapidly by change in temperature caused by lateral heat transfer. Due to the higher rate of temperature change with time ($\Delta T$ rate) at the airfoil and like sections, thermal stresses build up during heating and cooling and lead to occasional cracking of the mold and to more frequent cracking of the casting. Mold cracking occurs most often during heating of the mold to the casting temperature whereas cracking of the casting, of course, occurs during the cooling step. Cracking of the mold during the heating step might be prevented by strengthening the mold by increasing its thickness, changing its design, adding structural supports, or changing its composition. However, increased thickness and changes in the design of the mold upset the control of solidification which is essential to good yield. Changes in design or composition of the mold can also adversely affect directional solidification and even aggravate the problem of casting cracking. Therefore, any changes to alleviate mold cracking must be made with great care because of the many interactions and complications familiar to those skilled in the art. The problem of cracking at the bottom of the mold during heating, due to vertical heat loss to the cold chill plate, has been addressed by inserting a ceramic spacer between the mold and chill plate, as described in Hayes et al, U.S. Pat. No. 3,981,346. However, this approach does not address cracking in general, remote from the chill plate and, in particular, cracking attributable to differential lateral heat transfer.

Cracking in the airfoil section of the casting during cooling can be attributed to thermal stresses resulting from the same shape factors and differential temperatures which cause mold cracking. Airfoil cracking, which typically occurs longitudinally along the weaker grain boundaries in a columnar grain part, is further aggravated when the blade is to be hollow for cooling purposes. In casting a hollow blade, a core or strongback is suspended in the airfoil section of the mold cavity and, during cooling, it can exert considerable tension on the casting as a result of the different thermal expansion characteristics of the core or strongback as compared to the metal. Casting cracking is known to occur with certain alloys such as the nickel base alloy MAR-M 200 plus hafnium when cast in the complex geometries of advanced turbine blade designs in the columnar grained condition. During the cooling step of the process, the tension exerted on the thin walls of such a hollow blade casting can exceed the transverse tensile strength of the alloy and produce grain boundary cracks.

In addition, when multiple turbine blades are cast simultaneously in a mold; that is, a mold having a gating system including a central pour cup and individual runners to feed molten metal to a plurality of individual blade molds, cracking of the mold gating system at the bottom of the pour cup and at the runners may occur during mold heating as a result of thermal stresses.

Several prior art workers have utilized insulating material around casting molds for conventional and directional solidification casting processes. U.S. Pat. No. 3,367,393 of Lenahan et al; U.S. Pat. No. 3,478,815 of Worthington and U.S. Pat. No. 3,942,581 of Sawyer. However, the insulating material has been used for purposes other than preventing or controlling cracking of the mold and casting resulting from thermal stresses generated therein and the processes have not involved high rate directional solidification in which very high thermal gradients are required. The most widespread use of insulation on molds is to control grain size at certain portions of conventional castings, such as the trailing edge of an equiaxed gas turbine blade.

SUMMARY OF THE INVENTION

It is an object of the present invention to provide a method for substantially preventing cracking of a mold and metal casting therein during the heating and cooling steps of high rate directional solidification processes.

It is another object of the invention to prevent such cracking without adversely affecting the directionality of molten metal solidification.

An important feature of the invention is that insulating material is selectively applied to only those external mold surfaces corresponding to the mold section (or sections) having large surface area to volume ratios and high $\Delta T$ rate as compared to neighboring mold sections. Another important feature is that the insulating material is applied in only certain critical thicknesses, namely, those thicknesses at which heat transfer at said mold section is reduced sufficiently to substantially prevent build up of thermal stresses and cracking but insufficiently to disrupt the steep thermal gradient required for proper directional solidification. When these conditions are statisfied, mold and casting cracking can be substantially eliminated without adversely affecting the directionality of metal solidification. Of course, a substantial reduction of cracking provides improved metal yield, lower casting costs and reduced equipment downtime due to molten metal runouts.

The present invention is also highly useful in substantially preventing cracking of the gating system of a multi-casting mold during the heating step of the directional solidification process.

These and other advantages and objects of the present invention will appear more fully from the following drawings and description of the preferred embodiment.

BRIEF DESCRIPTION OF THE DRAWINGS

FIG. 1 is an elevation view of the turbine blade after removal from the mold and after machining of the root and shroud portions;

FIG. 2 is a lateral cross-sectional view through the airfoil section of a hollow turbine blade; and FIG. 3 is a vertical cross-sectional view of the casting mold used to make a hollow turbine blade, insulating material being disposed around the airfoil section of the mold.

DESCRIPTION OF THE PREFERRED EMBODIMENT

The present invention has wide applicability in high rate directional solidification processes including, but not limited to, those described in U.S. Pat. Nos. 3,700,023; 3,714,977 and 3,763,926. It can be utilized in conjunction with investment shell molds made by the well known "lost wax" process and with preformed, multi-part molds, as described in U.S. Pat. No. 3,965,963. The present invention is especially useful in high rate solidification processes in which a preformed strongback or core is used to produce hollow castings, U.S. Pat. No. 3,981,344. As used herein, mold is intended to include these and other mold types, configurations and assemblies.

The present invention is particularly well-adapted for making hollow turbine blade castings having a thinwall airfoil section and will be described hereinafter with reference to such. As shown in FIG. 1, the turbine blade includes airfoil section 4, root section 6 and shroud section 8. The blade airfoil is hollow to provide internal cooling during operation in the hot and corrosive environment of the gas turbine engine. As illustrated, the blade airfoil has thin walls, such as 0.025 inch in thickness, and a much greater length and surface area to volume ratio than either the root or shroud sections.

In forming a mold for the high rate directional solidification of such a blade, the well-known "lost wax" process may be utilized. The initial step of that process involves forming a wax pattern of the blade around a leachable core or the like, the core providing the desired internal passage in the cast airfoil. The assembly of pattern and core is then successively and repeatedly dipped in ceramic slurry, dusted with ceramic particulate and dried until a ceramic layer of desired thickness is obtained. Ceramics such as zirconia, alumina and the like are widely used. The ceramic coated assembly is thereafter heated to melt out the wax pattern and fire the ceramic layer into a strong mold for use in casting. A vertical cross section through a typical shell mold for one part produced by this technique is shown in FIG. 3. The mold casting cavity 12 is shaped and contoured similarly to the blade to be cast and includes airfoil section 14, root section 16 and shroud section 18. Below the root section is a growth zone 20 and above the shroud section is a riser cup 22. Suspended in the airfoil section is core 24 which defines the cooling cavity in the cast blade upon removal by leaching. The shell mold is shown having a generally constant thickness and is resting on a water cooled chill plate 26 prior to insertion into the heating zone of a suitable furnace.

As FIG. 3 shows, the airfoil section of the mold is smaller in width than the end sections. The surface to volume ratio of the airfoil section is greater than the end sections. The heat which is stored in a portion of a molten metal casting in a mold at a particular temperature is dependent on its unit volume while its capacity to lose that heat is dependent on its unit surface area. Consequently, high surface area to volume ratio casting section will cool more rapidly when exposed to the same environment. During the heating and cooling steps of the directional solidification process, the airfoil section of the mold in FIG. 3, as a high $\Delta T$ rate section, will change temperature more rapidly and attain final temperature, whether elevated or reduced, before either of the end sections. Such uneven heat transfer along the length of the mold and casting leads to the development of thermal stresses in the airfoil section and consequent cracking thereof, including occasional cracking of the mold and frequent cracking of the casting therein.

The presence of a core in the airfoil section of the mold cavity aggravates the casting cracking problem since the core usually has different thermal expansion characteristics from the solidified metal. Upon cooling, the core may exert sufficient outward pressure on the solidified metal to cause cracking thereof. Casting cracking is known to occur with the nickel base superalloy generally referred to as MAR-M 200 plus hafnium which has a somewhat lower transverse tensile strength and ductility in the columnar grained condition when compared to the same properties in the longitudinal direction. When thermal stresses during the cooling step exceed the transverse tensile strength, grain boundary cracking is observed.

In addition, when multiple turbine blades are cast simultaneously in a mold made by the "lost wax" process, cracking of the mold gating system at the bottom of the central pour cup and at the runners feeding molten metal to the casting cavities may occur during initial heating of the mold to the elevated casting temperature as a result of high lateral heat gain at these mold gating sections. Molten metal runouts subsequently result from such cracks.

According to the present invention, cracking of the mold and casting therein at the airfoil section shown in FIG. 3 can be substantially avoided by applying insulating material 28 to that section of the mold; that is, to those external mold surfaces corresponding with the airfoil section 14. Of course, if the airfoil section has a thin or bowed subsection which cracks, only that may require insulation. Also, insulating a high $\Delta T$ rate section may lead to alleviation of induced stress cracking in another section. Various insulating materials may be used including, but not limited to, woven or layered fibrous materials such as asbestos or aluminosilicates, such as Fiberfrax of the Carborundum Company and Kaowool of the Babcock & Wilcox Co. The material may be applied by wrapping, spraying and the like. In casting experiments, it was found convenient to wrap Fiberfrax insulation around the airfoil section. Essential to the success of the present invention is that the insulating material be applied selectively to those external mold surfaces corresponding with the high $\Delta T$ rate mold section (or sections), such as the airfoil section or subsection. If the entire mold is insulated, directionality of solidification is adversely affected, as shown hereafter in the examples. Likewise, a further requirement of the present invention is that the insulating material be applied to such thicknesses that heat transfer at the airfoil section is reduced sufficiently to prevent build up of thermal stresses and resulting cracking but insufficiently to adversely affect the steep thermal gradient in the molten and solid metal. If the insulation is applied too thickly, the thermal gradient will be disrupted and defective grain growth, such as freckle formation, will result. If applied too thinly, cracking of the mold and casting will occur. Of course, the critical range of insulation thickness will vary depending upon the type and manner of material applied and the shape of the mold and mold cavity. For Fiberfrax insulation having a thermal conductivity at 2000° F. of about 2 Btu-in-ft$^2$/hr-°F. wrapped tightly around the airfoil section, a thickness from about $\frac{1}{4}$ inch to 1 inch is generally suitable.

In similar fashion, cracking of the gating system of a gang mold used for simultaneously casting a plurality of turbine blades can be substantially avoided by applying insulating material to the pour cup and individual runners; that is, to those external mold gating surfaces corresponding with the gating section (or sections) having high heat transfer as compared to neighboring gating sections. Insulation thickness at the gating section must be sufficient to prevent build up of harmful thermal stresses and cracking but insufficient to greatly extend the time required for complete metal solidification, the directionality of solidification being of little concern at the gating section.

The present invention permits high rate directional solidification of molten metals to be carried out with a minimum of mold and casting cracking. In commercial production, the elimination of cracking will prevent costly molten metal runouts and damage of equipment. Improved metal yield and reduced part cost will be realized.

The following examples are offered to further illustrate and explain the present invention.

EXAMPLE 1

A predominantly alumina shell mold having a casting cavity in a turbine blade configuration exhibited a tendency for cracking in the mold and casting airfoil section during high rate directional solidification processes. Prior to mold heatup, Fiberfrax insulation of $\frac{1}{2}$ inch thickness was wrapped around the entire circumference of the mold from slightly above the chill plate surface to one inch above the blade tip. The mold was then preheated to 2750° F., filled with molten MAR-M 200 plus hafnium alloy at 2800° F. and the mold gradually withdrawn from the heating zone of the furnace into a cooling zone where heat was removed by radiation from the mold walls in addition to through the chill plate to effect solidification. Although cracking was prevented, this insulating procedure disrupted the critical thermal gradient required to produce an acceptable directionally solidified grain structure, as evidenced by areas of deleterious equiaxed grains in the blade casting. The blade so produced was unacceptable for intended use.

EXAMPLE 2

A predominantly alumina shell mold having a casting cavity contoured to produce a turbine blade having very thin walls in the upper two-thirds of the airfoil section exhibited occasional mold cracking and a high incidence of grain boundary casting crackings at the very thin wall subsection. Prior to mold heatup, Fiberfrax insulation of $\frac{1}{2}$ inch thickness was selectively wrapped around the airfoil section from $\frac{1}{2}$ inch above the root platform to one inch above the blade tip to insulate the subsection. As in Example 1, the mold was preheated to 2750° F., filled with molten alloy at 2800° F. and the mold withdrawn from the heating zone of the furnace. This insulating procedure resulted in a substantial reduction in cracking, being especially effective in reducing grain boundary cracking of the very thin walls of the casting to a low, acceptable level without detrimentally affecting the directionally solidified grain structure.

EXAMPLE 3

A predominately alumina mold including seven individual turbine blade cavities having individual runners connected to a central pour cup often cracked on heatup to 2750° F. at the runners and at the juncture of the runners and pour cup. Fiberfrax insulation of $\frac{1}{2}$ inch thickness was selectively wrapped around the lower part of the pour cup where the runners were attached and around each runner prior to mold heatup and resulted in a significant reduction in cracking at those sections of the gating system.

Although the present invention has been described with reference to the production of turbine blade castings, those skilled in the art will recognize that the invention is not so limited. Other article shapes can of course be cast with the aid of the present invention. The present invention will be useful in making articles whenever the casting cavity of the mold provides at least one mold section along the length of the mold having higher temperature rate of change capability than neighboring mold sections and whenever cracking at a section occurs as a result of thermal stresses generated during the heating and cooling steps of the high rate directional solidification process.

Of course, those skilled in the art will also recognize that other changes, omissions and additions in the form and detail thereof may be made to the preferred embodiment without departing from the spirit and the scope of the invention.

Having thus described typical embodiments of our invention, that which we claim as new and desire to secure by Letters Patent of the United States is:

1. A solidification process for making columnar grain or single crystal metal castings which comprises placing vertically on a chill plate a ceramic shell mold having an open end resting on the chill plate, the mold having sections of varying surface area to volume ratio along its vertical length; heating the mold to an elevated temperature in a heating zone; pouring molten metal into the mold; gradually withdrawing the chill plate and mold vertically from the heating zone into a cooling zone so that heat is removed laterally and vertically from the molten metal; said vertical motion causing a high thermal gradient to move through the molten metal which thereby causes high rate directional solidification along the vertical length of the mold; characterized by applying insulation to a first mold section having increased surface area to volume ratio as compared to neighboring sections along the length of the mold, to decrease lateral heat flow during the heating and cooling steps, the insulation being of a thickness which is sufficient to lower the temperature differential between the first mold section and the neighboring sections to a level that produces a crack free mold upon heating and a crack free casting upon cooling, and which is insufficient to change the direction of solidification in the first mold section upon cooling from that caused by the vertical motion; and, concurrently maintaining the neighboring mold sections in uninsulated condition.

2. The process of claim 1 wherein a portion of the ceramic shell mold contains a core and has the shape of a gas turbine blade having a root and an opposing shroud shaped end connected by a hollow airfoil section formed around the core, wherein the directional solidification process causes the formation of a columnar grain; and, wherein the identical solidification process using said mold in a condition free of insulation produces a hollow metal casting with cracks running vertically along columnar grain boundaries, characterized by insulating the airfoil portion of the turbine blade.

* * * * *